US010850505B2

(12) United States Patent
Umeda et al.

(10) Patent No.: US 10,850,505 B2
(45) Date of Patent: Dec. 1, 2020

(54) PRINTHEAD AND PRINTING APPARATUS

(71) Applicant: CANON KABUSHIKI KAISHA, Tokyo (JP)

(72) Inventors: Kengo Umeda, Tokyo (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/381,417

(22) Filed: Apr. 11, 2019

(65) Prior Publication Data

US 2019/0232644 A1 Aug. 1, 2019

Related U.S. Application Data

(63) Continuation of application No. 15/584,435, filed on May 2, 2017, now Pat. No. 10,315,415.

(30) Foreign Application Priority Data

May 27, 2016 (JP) ..... 2016-106711

(51) Int. Cl.
*B41J 2/045* (2006.01)
*B41J 2/14* (2006.01)

(52) U.S. Cl.
CPC ..... *B41J 2/04548* (2013.01); *B41J 2/0455* (2013.01); *B41J 2/0458* (2013.01); *B41J 2/04568* (2013.01); *B41J 2/04586* (2013.01); *B41J 2/14072* (2013.01); *B41J 2002/14491* (2013.01); *B41J 2202/13* (2013.01)

(58) Field of Classification Search
CPC ..... B41J 2/0455
See application file for complete search history.

(56) References Cited

U.S. PATENT DOCUMENTS 6,076,914 A 6/2000 Imai
6,962,405 B2 11/2005 Imanaka et al.
(Continued)

FOREIGN PATENT DOCUMENTS

CN 1490162 A 4/2004
CN 1251872 C 4/2006
(Continued)

OTHER PUBLICATIONS

Machine generated English translation of JP02204058 to Abe, "Driving Circuit of Electronic Device"; retrieved via espacenet.com on Mar. 28, 2020; 3pp.*
(Continued)

*Primary Examiner* — Shelby L Fidler
(74) *Attorney, Agent, or Firm* — Venable LLP

(57) ABSTRACT

A printhead includes a printing element; a first power supply wiring configured to be electrically connected to one terminal of the printing element and supply power to the printing element; a transistor configured to be electrically connected to another terminal of the printing element and drive the printing element; a first ground wiring configured to be electrically connected to a source of the transistor; a second ground wiring configured to be electrically connected to a back gate of the transistor; and a first capacitive element configured to be electrically connected, at one terminal thereof, to the first ground wiring and electrically connected at another terminal thereof, to the second ground wiring.

17 Claims, 19 Drawing Sheets

(56) References Cited

U.S. PATENT DOCUMENTS

| | | | | |
|---|---|---|---|---|
| 7,354,125 | B2 | 4/2008 | Hirayama et al. | |
| 7,581,797 | B2 | 9/2009 | Kasai | |
| 7,815,272 | B2 | 10/2010 | Kasai et al. | |
| 7,896,474 | B2 | 3/2011 | Kasai et al. | |
| 8,944,550 | B2 | 2/2015 | Kasai et al. | |
| 9,039,144 | B2 | 5/2015 | Umeda | |
| 9,099,918 | B2 | 8/2015 | Sato | |
| 9,272,508 | B2 | 3/2016 | Umeda et al. | |
| 9,688,067 | B2 | 6/2017 | Umeda et al. | |
| 2004/0160485 | A1 | 8/2004 | Imanaka et al. | |
| 2005/0062802 | A1 | 3/2005 | Kawamura | |
| 2005/0237353 | A1* | 10/2005 | Oomura | B41J 2/04513 347/9 |
| 2009/0058897 | A1 | 3/2009 | Han et al. | |
| 2009/0066374 | A1* | 3/2009 | Nagumo | B41J 2/45 327/109 |
| 2010/0007685 | A1 | 1/2010 | Kosugi | |
| 2012/0194155 | A1* | 8/2012 | Sato | B41J 2/04541 323/282 |
| 2016/0121608 | A1 | 5/2016 | Fujii et al. | |
| 2017/0348979 | A1 | 12/2017 | Umeda et al. | |

FOREIGN PATENT DOCUMENTS

| | | | | |
|---|---|---|---|---|
| CN | 102089153 | A | | 6/2011 |
| CN | 102624224 | A | | 8/2012 |
| CN | 104210234 | A | | 12/2014 |
| CN | 104417051 | A | | 3/2015 |
| JP | 02204058 | A | * | 8/1990 |
| JP | 2004-042558 | A | | 2/2004 |
| JP | 2004-098465 | A | | 4/2004 |
| JP | 2007-022069 | A | | 2/2007 |
| JP | 2010-040787 | A | | 2/2010 |
| JP | 2014-197648 | A | | 10/2014 |
| JP | 2014-233894 | A | | 12/2014 |

OTHER PUBLICATIONS

Office Action dated Feb. 1, 2019, in Chinese Patent Application No. 201710411549.3.

Office Action dated Mar. 23, 2020, in Japanese Patent Application No. 2016-106711.

Office Action dated Sep. 3, 2020, in Chinese Patent Application No. 201911088338.6.

Office Action dated Oct. 12, 2020, in Japanese Patent Application No. 2016-106711.

* cited by examiner

WHEN CAPACITIVE ELEMENT 113 IS NOT DISPOSED

WHEN CAPACITIVE ELEMENT 113 IS DISPOSED

WHEN CAPACITIVE ELEMENT 113 IS NOT DISPOSED

WHEN CAPACITIVE ELEMENT 113 IS DISPOSED

WHEN CAPACITIVE ELEMENT 113 AND CAPACITOR 201 ARE DISPOSED

PRINTHEAD AND PRINTING APPARATUS

This application is a continuation of U.S. patent application Ser. No. 15/584,435, filed May 2, 2017, which claims the benefit of Japanese Patent Application No. 2016-106711, filed May 27, 2016, which are hereby incorporated by reference herein in their entirety.

BACKGROUND OF THE INVENTION

Field of the Invention

The present invention relates to a printhead and a printing apparatus.

Description of the Related Art

Conventionally, it has been necessary to apply a stable voltage to a heater in order to achieve stable discharge characteristics in an inkjet printhead that discharges ink from a plurality of discharge ports using thermal energy. In an element substrate for a printhead, a plurality of heaters, and a plurality of driving elements corresponding to the plurality of heaters are arranged. A driving element is configured by a field-effect transistor, and drives a heater by switching. When a plurality of such heaters are simultaneously driven, a large current flows to a ground wiring and a drive power supply wiring supplying power to the heaters. There is a problem in that electromagnetic noise due to inductive coupling occurs in the ground wiring and the drive power supply wiring on the rising edge and the trailing edge of the supply of such a large current.

A logic circuit, other than a heater, that receives and processes high-speed print data is disposed on an element substrate of a printhead. For this reason, there is the possibility that a logic circuit malfunction will occur when electromagnetic noise due to the foregoing inductive coupling occurs in the ground wiring. Accordingly, a configuration in which, in the element substrate and the printhead, a ground wiring for a heater and a ground wiring for a logic circuit and the element substrate are separated is taken. By this, electromagnetic noise that occurs when a plurality of heaters are driven propagating to the ground wiring for the logic circuit and the element substrate is prevented, and the logic circuit malfunctioning is prevented. In Japanese Patent Laid-Open No. 2004-42558, to prevent noise propagation, configuration is taken so as to leave a space of at least a predetermined width between an input terminal and a logic circuit and a power line.

In recent years, to realize higher speed printing, a full-line printhead in which a plurality of element substrates are arranged, and that has a print width equal to or larger than a print medium has been proposed. In accordance with a print width of a full-line printhead, the length of wiring of the drive power supply wiring to the element substrates from the power circuit and capacitor and the length of a ground wiring become longer. Since a parasitic inductance component of a wiring becomes larger as the length of wiring becomes larger, ringing occurs when a large current flows. A potential difference between the ground wiring for a heater and the ground wiring for an element substrate temporarily occurs due to such ringing. A parasitic field-effect transistor which is a driving element turns on by this potential difference, and as a result, a large current on the order of A (amperes) flows in the parasitic transistor, and a malfunction of the driving element occurs.

SUMMARY OF THE INVENTION

The present invention realizes higher reliability in an element substrate for which wiring is long by achieving both logic circuit and driving element malfunction prevention.

According to one aspect of the present invention, there is provided a printhead, comprising a printing element; a first power supply wiring configured to be electrically connected to one terminal of the printing element and supply power to the printing element; a transistor configured to be electrically connected to another terminal of the printing element and drive the printing element; a first ground wiring configured to be electrically connected to a source of the transistor; a second ground wiring configured to be electrically connected to a back gate of the transistor; and a first capacitive element configured to be electrically connected, at one terminal thereof, to the first ground wiring and electrically connected, at another terminal thereof, to the second ground wiring.

According to another aspect of the present invention, there is provided a printing apparatus, comprising: a printhead and a control substrate, the printhead comprising: a printing element; a power supply wiring configured to be electrically connected to one terminal of the printing element and supply power to the printing element; a transistor configured to be electrically connected to another terminal of the printing element and drive the printing element; a first ground wiring configured to be electrically connected to a source of the transistor; a second ground wiring configured to be electrically connected to a back gate of the transistor; and a first capacitive element configured to be electrically connected, at one terminal thereof, to the first ground wiring and electrically connected, at another terminal thereof, to the second ground wiring, and the control substrate comprising: a power circuit configured to be connected to the printing element via the power supply wiring and generate power to be supplied to the printing element, wherein the first ground wiring and the second ground wiring are electrically connected on the control substrate.

By the present invention, it is possible to suppress the occurrence of ringing according to the rising edge and the trailing edge of a current at a time of driving a printing element, and prevent a malfunction of a logic circuit and a driving element.

Further features of the present invention will become apparent from the following description of exemplary embodiments (with reference to the attached drawings).

DESCRIPTION OF THE EMBODIMENTS

Figure 1:
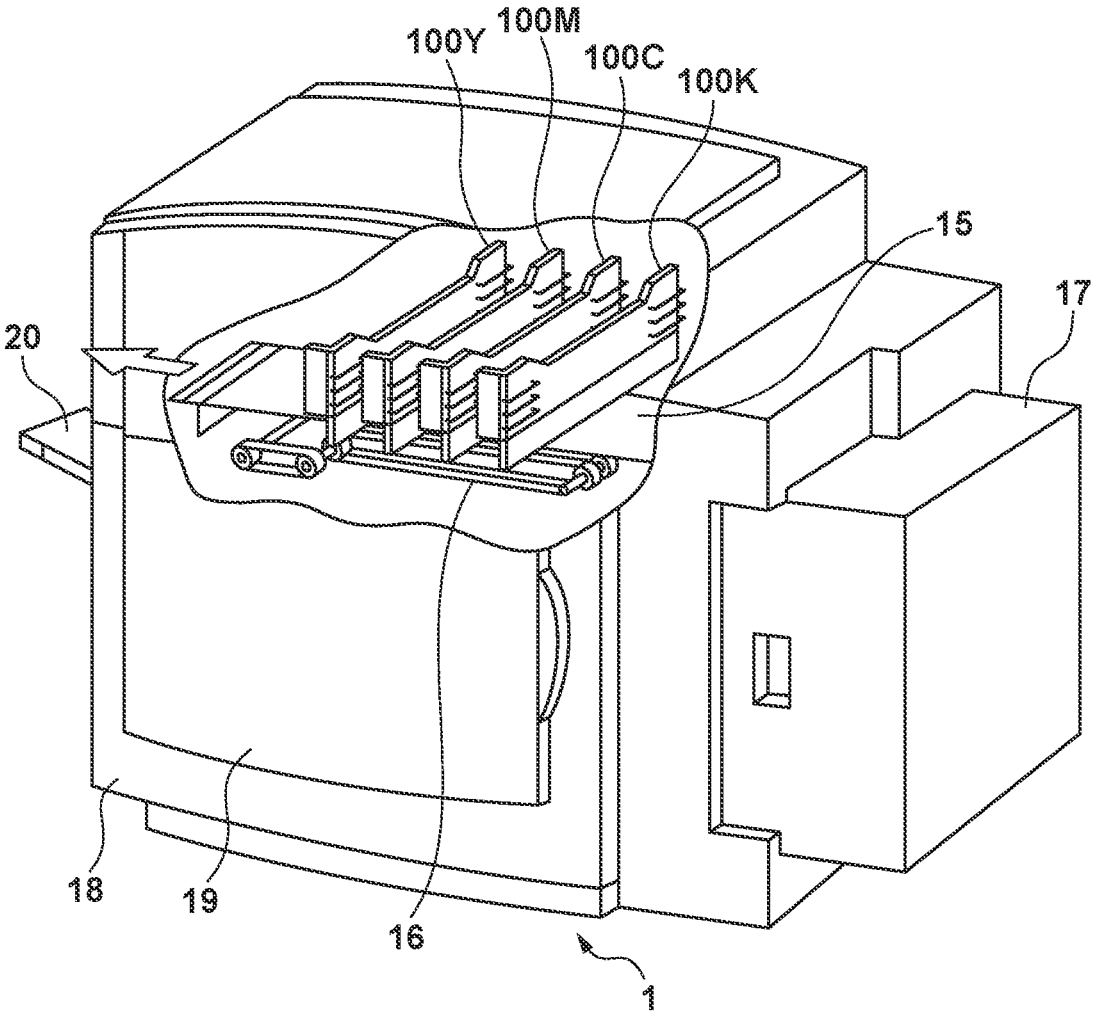
FIG. 1 is an external perspective view illustrating an example of a configuration of an inkjet printing apparatus.

Below, more specific descriptions are given in detail of preferred embodiments of the present invention, with reference to the attached drawings. However, relative arrangements of configuration elements, and the like that are recited in the present embodiment are not intended to limit the scope of the invention thereto, unless specifically stated.

Note that in this specification, "print" encompasses forming not only meaningful information such as characters and shapes, but also meaningless information. Furthermore, "print" broadly encompasses cases in which an image or pattern is formed on a print medium irrespective of whether or not it is something that a person can visually perceive, and cases in which a medium is processed.

Also, "print medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Accordingly, "ink" encompasses liquids that by being applied to a print medium can be supplied in the forming of images, patterns or the like, processing of print mediums, or processing of ink (for example, insolubilization or freezing of a colorant in ink applied to a print medium).

Furthermore, "print element", unless specified otherwise, encompasses a discharge port and an element that produces energy that is used for discharge of ink and a fluid channel that communicates therewith collectively.

Furthermore, "nozzle", unless specified otherwise, encompasses a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

For an inkjet printhead (hereinafter referred to as printhead) having the most important features of the present invention, on an element substrate of a printhead, a plurality of printing elements and a driving circuit that drives these printing elements are implemented on the same substrate. As will be clear from the description below, a plurality of element substrates are integrated in a printhead, and these element substrates have a cascade connection structure. Accordingly, this printhead is able to achieve a print width that is relatively long. Accordingly, the printhead is used not only in a serial type printing apparatus that is commonly found, but also in a printing apparatus comprising a full-line printhead whose print width corresponds to the width of the print medium. Also, the printhead is used in large format printers that use print mediums of a large size such as A0 and B0 in serial type printing apparatuses.

Accordingly, firstly, a printing apparatus in which the printhead of the present invention is used is described.

Printing Apparatus Overview Description

FIG. 1 is a perspective view for describing a structure of a printing apparatus 1 comprising a recovery unit for ensuring continuously stable ink discharge for full-line inkjet printheads (hereinafter referred to as printheads) 100K, 100C, 100M, and 100Y.

In the printing apparatus 1, a printing sheet 15 (that is, a print medium) is supplied to a print position according to a printhead from a feeder unit 17, and is conveyed by a conveyance unit 16 comprised in a housing 18 of the printing apparatus.

In printing of an image to the printing sheet 15, black ink is discharged from a printhead 100K when a nominal position of the printing sheet 15 reaches a position below the printhead 100K for discharging black (K) ink while the printing sheet 15 is being conveyed. Similarly, a color image is formed by discharging each color of ink when the printing sheet 15 reaches each nominal position in order of the printhead 100C for discharging cyan (C) ink, the printhead 100M for discharging magenta (M) ink, and the printhead 100Y for discharging yellow (Y) ink. The printing sheet 15 on which an image is printed in this way is discharged to a stacker tray 20.

The printing apparatus 1 further comprises the conveyance unit 16, and a replaceable ink cartridge (not shown) for each ink for supplying ink to the printheads 100K, 100C, 100M, and 100K. Also, it comprises a pump unit (not shown) for supplying ink to the printhead 100 and a recovery operation and a control substrate (not shown) for controlling the printing apparatus 1 as a whole. Also, a front door 19 is an opening/closing door for replacing an ink cartridge.

Control Configuration

Next, description is given for a control configuration for executing print control of a printing apparatus described by using FIG. 1.

Figure 2:
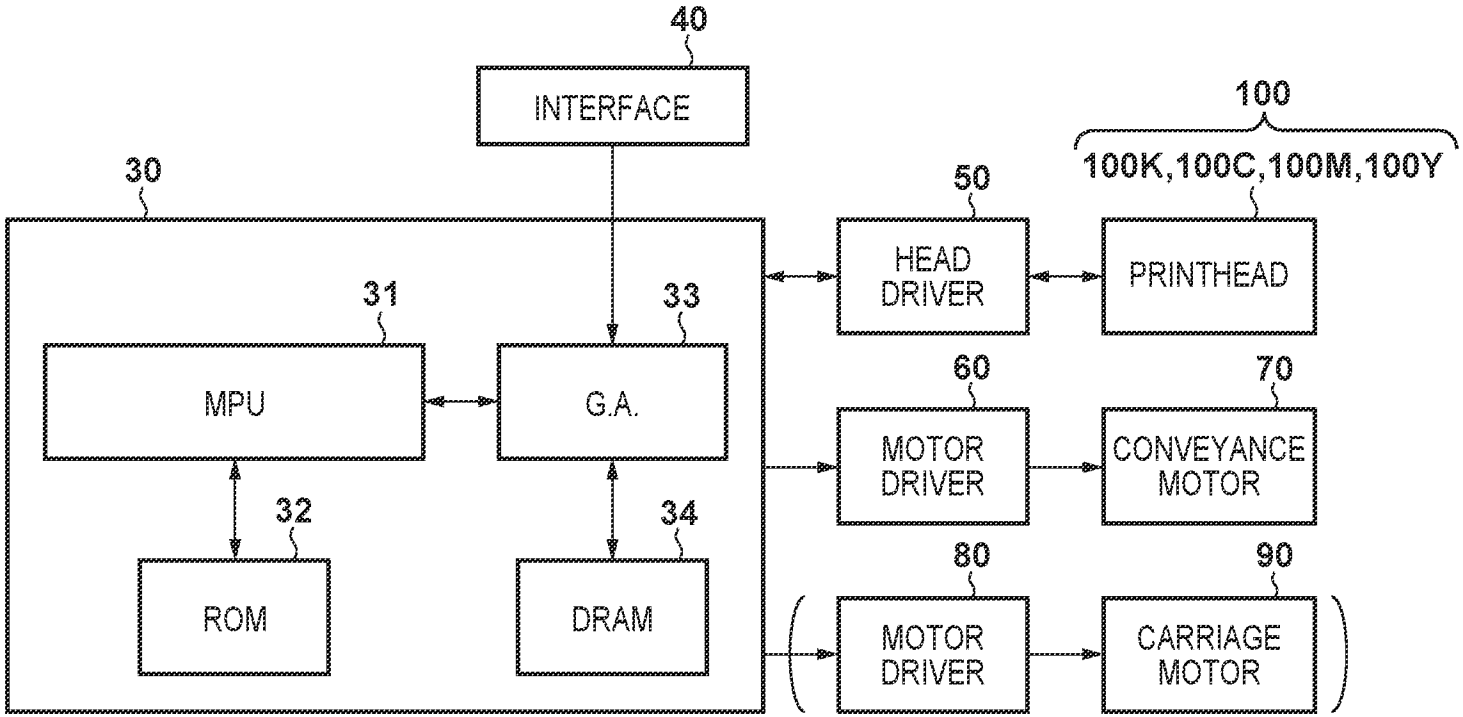
FIG. 2 is a view illustrating an example of a control configuration of the inkjet printing apparatus according to the present application invention.

FIG. 2 is a block diagram illustrating a configuration of a control circuit of the printing apparatus. In FIG. 2, a controller 30 is configured to include an MPU 31, a ROM 32, a gate array (G.A.) 33, and a DRAM 34. An interface 40 is an interface for inputting print data. The ROM 32 is a non-volatile storage region, and stores control programs that the MPU 31 executes. The DRAM 34 is a DRAM that saves data such as print data and a printing signal supplied to the printhead 100. The gate array 33 is a gate array that performs control for supplying a printing signal to the printhead 100, and performs data transfer control between the interface 40, the MPU 31, and the DRAM 34. A carriage motor 90 is a motor for conveying the printhead 100 (100K, 100C, 100M, and 100Y). A conveyance motor 70 is a motor for print paper conveyance. A head driver 50 drives the printhead 100. Motor drivers 60 and 80 are motor drivers for driving the conveyance motor 70 and the carriage motor 90, respectively.

Note that in a printing apparatus of a configuration using a full-line printhead as illustrated in FIG. 1, the carriage motor 90 and the motor driver 80 for driving that motor are not present. Accordingly, in FIG. 2, they are put in parentheses.

Regarding operation of the foregoing control configuration, print data is converted into a printing signal for printing between the gate array 33 and the MPU 31 when the print data is entered into the interface 40. Also, in addition to the motor drivers 60 and 80 being driven, the printhead 100 is driven in accordance with print data sent to the head driver 50, and printing is performed.

First Embodiment

Figure 3:
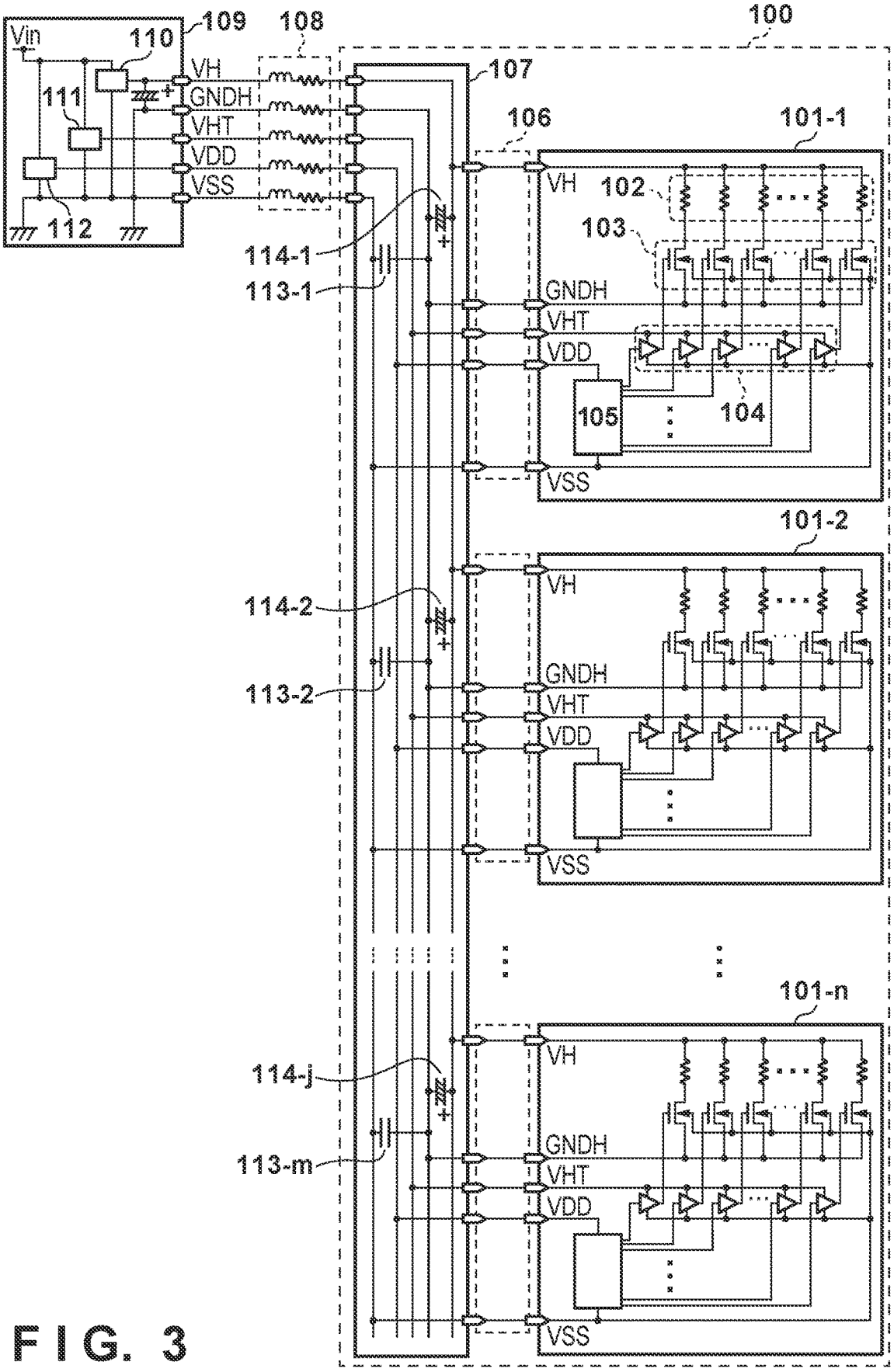
FIG. 3 is a view illustrating an example of a configuration of the printhead according to a first embodiment.

FIG. 3 illustrates an example of a configuration of the printhead 100 in the printing apparatus 1 according to a first embodiment of the present invention. The printhead 100 is configured to include a plurality of printing element substrates 101, a plurality of flexible substrates 106, and a print circuit board 107. The plurality of the printing element substrates 101 are each electrically connected to the print circuit board 107 via a respective flexible substrate 106. The print circuit board 107, via cables 108, is electrically connected to a head control substrate 109 which is arranged on the main body of the printing apparatus 1.

The printing element substrate 101 is described in detail. The printing element substrate 101 is an element substrate, and is configured to include a plurality of heaters 102, a plurality of driving elements 103, a plurality of control gates 104, and a logic circuit 105.

The heater 102 is a group of heaters which are printing elements for heating and discharging ink. The driving element 103 is a group of driving elements for driving the heater 102. A field-effect transistor (FET: Field Effect Transistor) is mainly used as the driving element 103. In the present embodiment, it is assumed that an N-type field-effect transistor is used for the driving element 103.

The control gate 104 is a control gate group for controlling the driving element 103. The logic circuit 105 is a logic circuit for sending a control signal to the control gate 104. The logic circuit 105 is mainly configured from a shift register circuit or a latch circuit for holding print data, an HE generation circuit for generating a heat-enable (HE) pulse for deciding the driving element electrical connection time, and the like.

One terminal of the heater 102 is connected to a printing element power supply (VH), and the other terminal is connected to a drain terminal of the FET which is the driving element. Also, the source terminal of the driving element 103 is connected to a printing element ground wiring (GNDH), and a substrate terminal (back gate) of the driving element 103 is connected to a substrate ground wiring (VSS). A power supply of the control gate 104 is connected to a control gate power supply wiring (VHT), and the power supply of the logic circuit 105 is connected to a logic circuit power supply wiring (VDD). Ground terminals of the control gate 104 and the logic circuit 105 are connected to the substrate ground wiring (VSS).

A printing element power supply (VH) for driving a printing element (the heater 102) is connected to a power circuit 110 on the head control substrate 109. Also, a power supply from the power circuit 110 is supplied to each of the printing element substrates 101 via the cables 108, the print circuit board 107, and the flexible substrates 106. The printing element ground wiring (GNDH) and the substrate ground wiring (VSS) are separated with respect to direct current in the printhead 100, and are short-circuited on the head control substrate 109. By this, electromagnetic noise that occurs when the plurality of heaters 102 are driven propagating to the substrate ground wiring (VSS) is prevented, and the logic circuit malfunctioning is prevented.

A control gate power supply wiring (VHT) for controlling the control gate 104 is connected to a power circuit 111 on the head control substrate 109, and power is supplied thereby. A logic circuit power supply wiring (VDD) for controlling the logic circuit 105 is connected to a power circuit 112 on the head control substrate 109, and power is supplied thereby.

There are cases when the length of the wiring of the cable 108 is greater than or equal to 1 m due to restrictions in the arrangement in the printing apparatus 1 of the printhead 100 and the head control substrate 109, and the amount of parasitic inductance increases in conjunction with this. Specifically, the order of several hundred nH to 1 μH is reached in the cable 108 alone. To reduce VH-GNDH ringing that occurs due to a large parasitic inductance of the cable 108, a capacitor 114 between VH and GNDH is disposed on the print circuit board 107. An electrolyte capacitor of several hundred μF, for example, is used for the capacitor 114. Furthermore, a capacitive element 113 is a capacitive element arranged between ground wirings (between VSS and GNDH) as a suppression element disposed to suppress an excessive potential difference between GNDH and VSS that occurs due to parasitic inductance of the cable 108, and prevent a malfunction of the driving element 103. A ceramic capacitor of approximately several tens of nF to several hundred nF, for example, is used for the capacitive element 113. A capacity of the capacitive element 113 is selected so that impedance becomes lowest in a frequency band of a ringing waveform of GNDH. Also, it is better to arrange the capacitive element 113 at a position as close as possible to the printing element substrate 101 to reduce the parasitic inductance. For that reason, if it is arranged on the print circuit board 107, it is desirable that it be arranged in a vicinity of a portion for connecting to the flexible substrate 106 whose distance from the printing element substrate 101 is smallest.

Figure 4A:
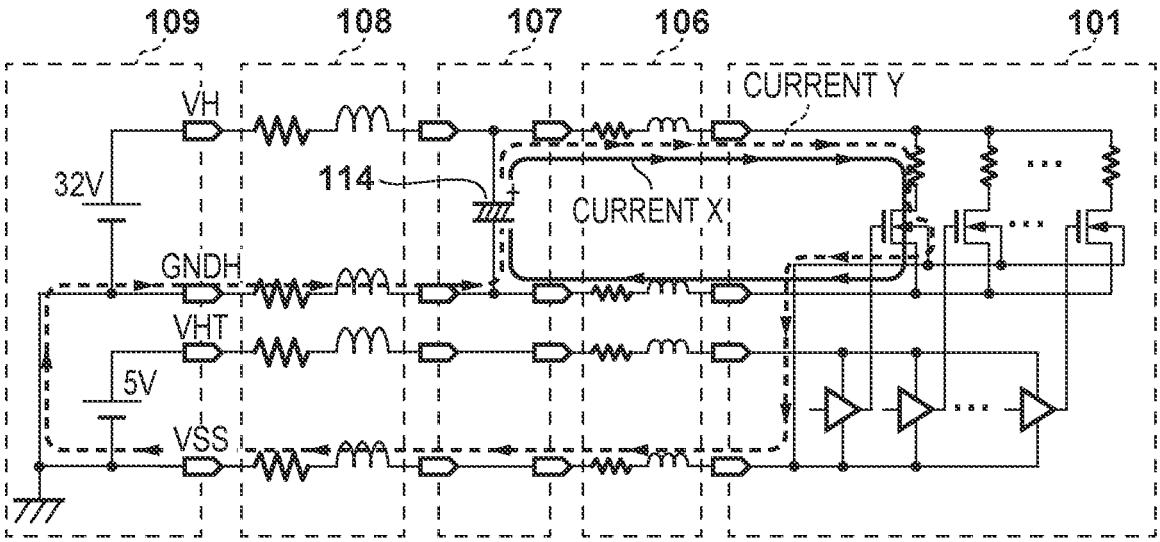
FIGS. 4A and 4B are views for describing equivalent circuits of the printhead according to the first embodiment.
Figure 4B:
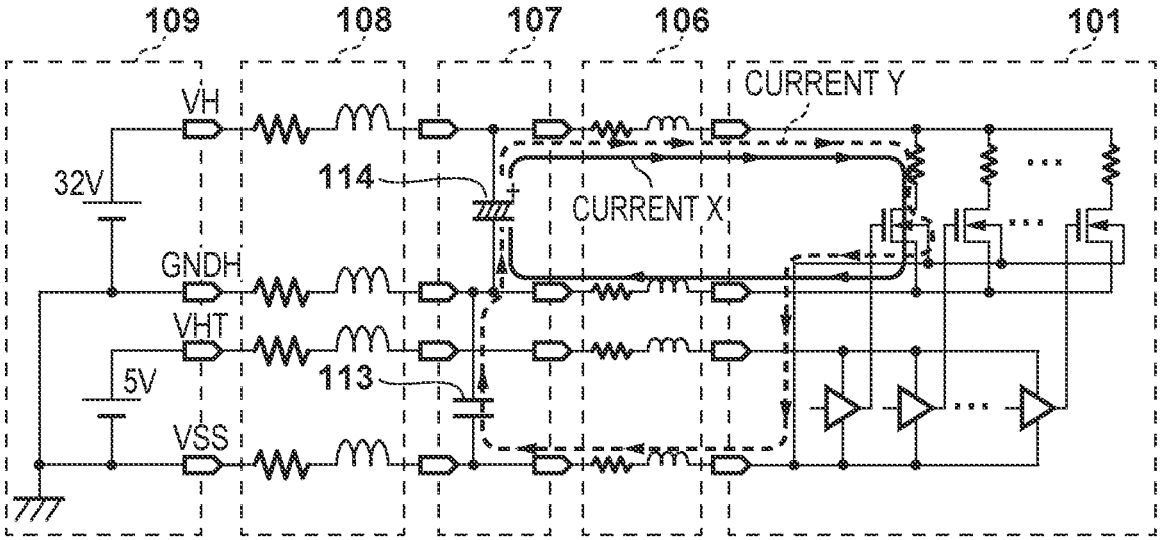
Figure 5A:
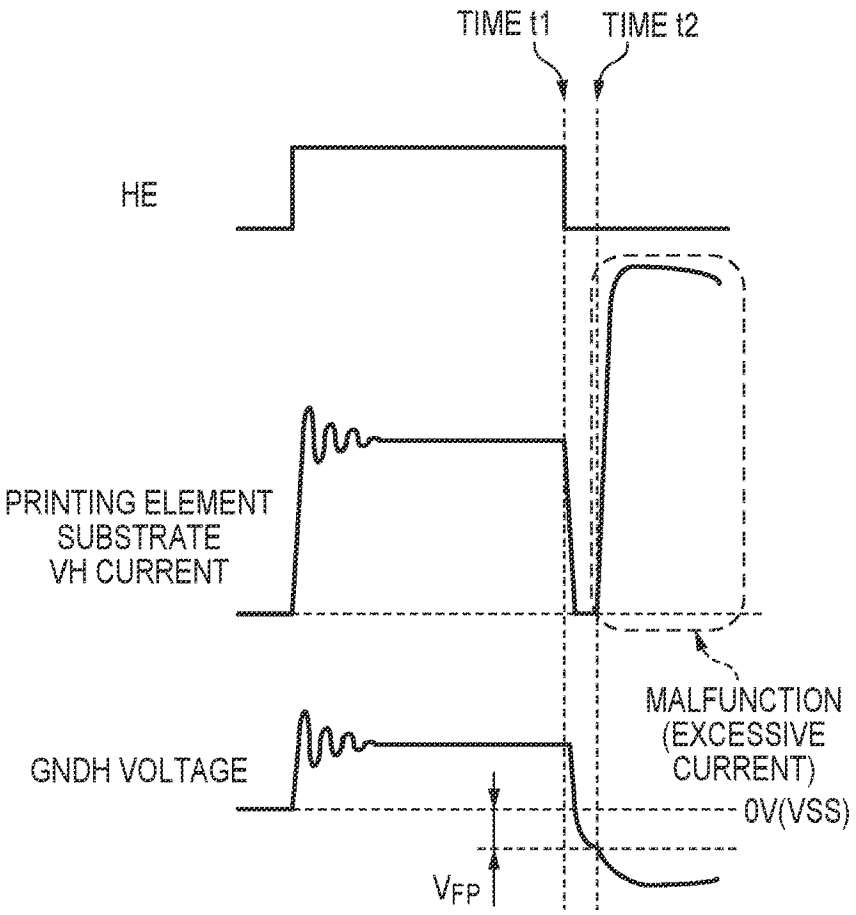
FIGS. 5A and 5B are views for describing operation waveforms of the printhead according to the first embodiment.
Figure 5B:
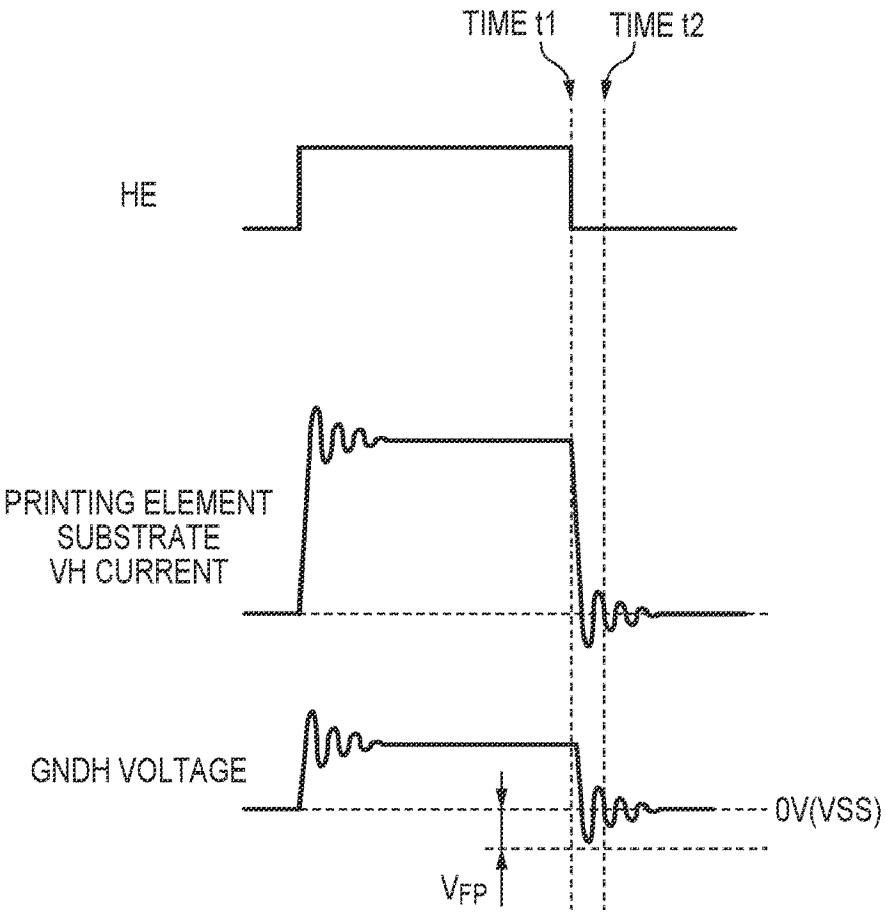

FIGS. 4A and 4B are views for describing equivalent circuits of the printhead 100 according to a first embodiment. Also, FIGS. 5A and 5B are views for describing operation waveforms of the printhead 100 according to a first embodiment. An effect of the capacitive element 113 which is arranged between the ground wirings will be described using FIG. 4A, FIG. 4B, FIG. 5A, and FIG. 5B. Arrow symbols illustrated in FIG. 4A and FIG. 4B indicate a path of VH current of the printing element substrate 101 at time t1 (refer to FIG. 5A and FIG. 5B) which is a time of a trailing edge of the VH current.

At time t1, two current paths—current X indicated by a solid line and current Y indicated by a broken line—occur (refer to FIG. 4A and FIG. 4B). The current X is a current that flows between VH and GNDH, and is a normal current path for when driving the heater 102. The current Y is a current that flows between VH and VSS, and is a leakage current that occurs when the FET which is the driving element 103 transitions from an on state to an off state. Specifically, it is a leakage current that occurs due to a positive charge being trapped in a depletion layer of the FET.

Figure 6:
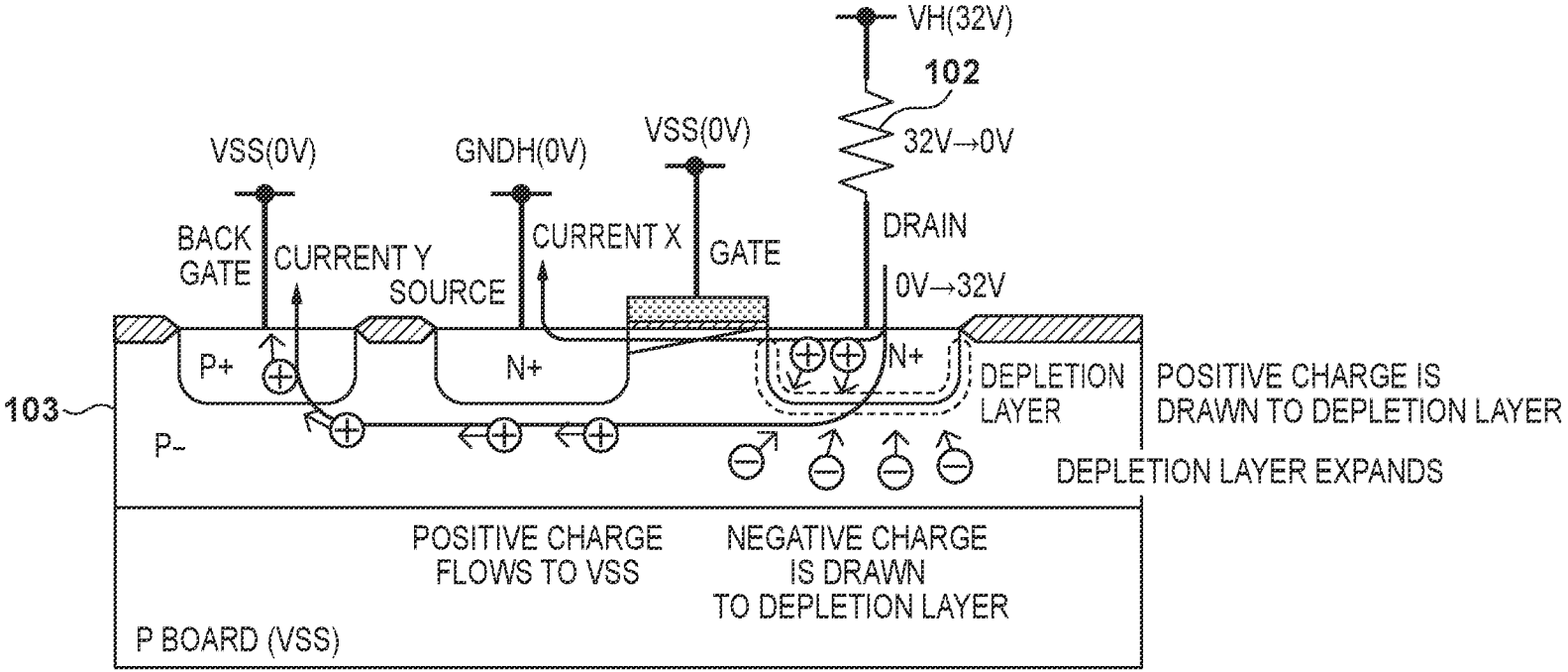
FIG. 6 is a cross-sectional view for describing operation of a driving element.

FIG. 6 is a view illustrating a cross section of the driving element (FET) at time t1. At time t1, the driving element transitions from the on state to the off state, and therefore the drain terminal gradually increases from 0V to the voltage of VH (32V). The depletion layer of a PN junction portion of the driving element expands by this, and a + charge of an N diffusion layer on the drain side of the driving element is drawn towards the depletion layer, and a + charge of a P diffusion layer on the source side flows out towards the 0V (VSS). By this, the current Y momentarily flows between VH and VSS.

FIG. 4A illustrates a current path of a case in which the capacitive element 113 is not disposed between the ground wirings. Since the current Y that flows between VH and VSS is momentarily supplied from the capacitor 114, it flows ultimately toward GNDH. Accordingly, it flows into the head control substrate 109 in which VSS and GNDH are short-circuited. Because the current Y passes through the cable 108 which has large parasitic inductance at that time, large ringing occurs on the negative side in GNDH. Time t2 of FIG. 5A indicates that state.

Due to this ringing, a negative potential difference occurs momentarily between VSS which is the substrate potential of the driving element (FET) and GNDH. When this exceeds the forward voltage VFP of a parasitic transistor of the driving element (FET), the parasitic NPN transistor of the driving element (FET) turns on, a large current occurs, and a malfunction of the driving element occurs. The forward voltage VFP is a value determined by the material of the semiconductor, and is small (0.3V to 0.7V) in the case of silicon. For this reason, there is a possibility that a parasitic NPN transistor of a driving element will turn on even with slight ringing.

Figure 7:
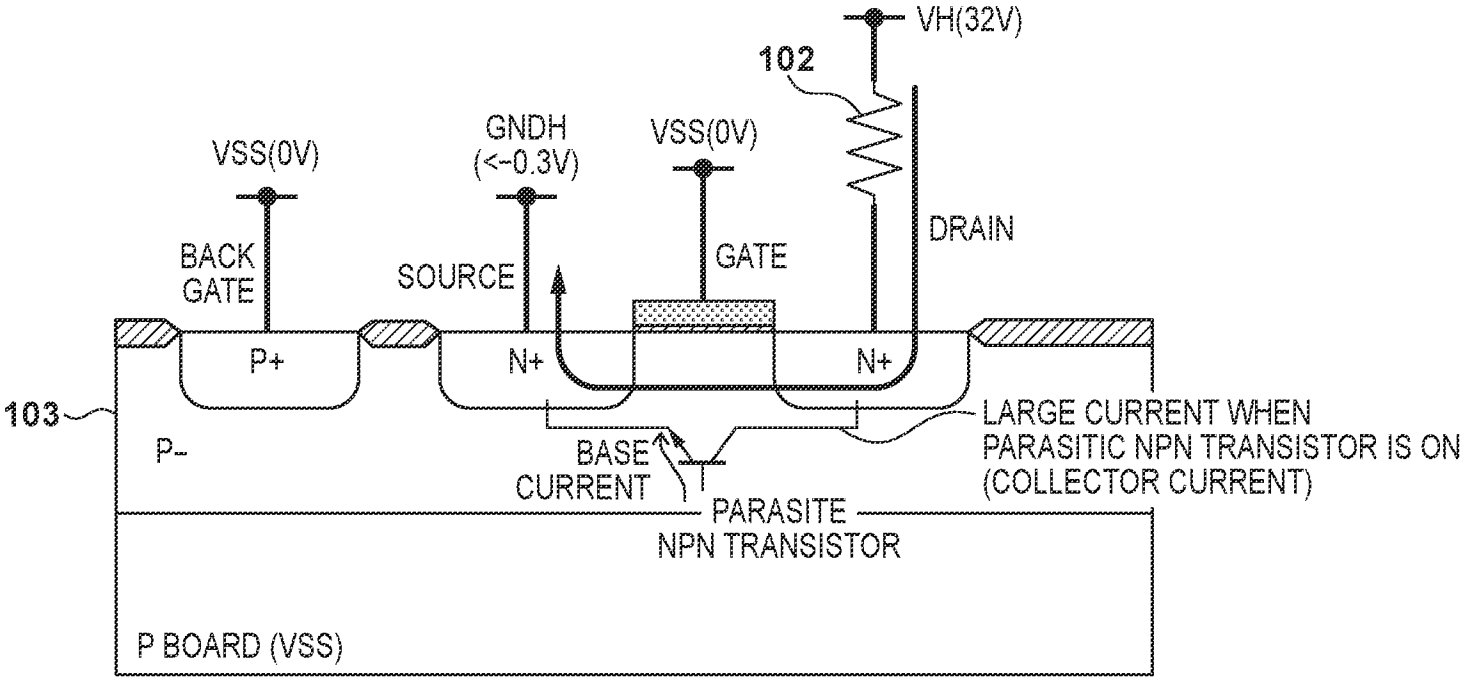
FIG. 7 is a cross-sectional view for describing the driving element in a malfunction state.
Figure 8:
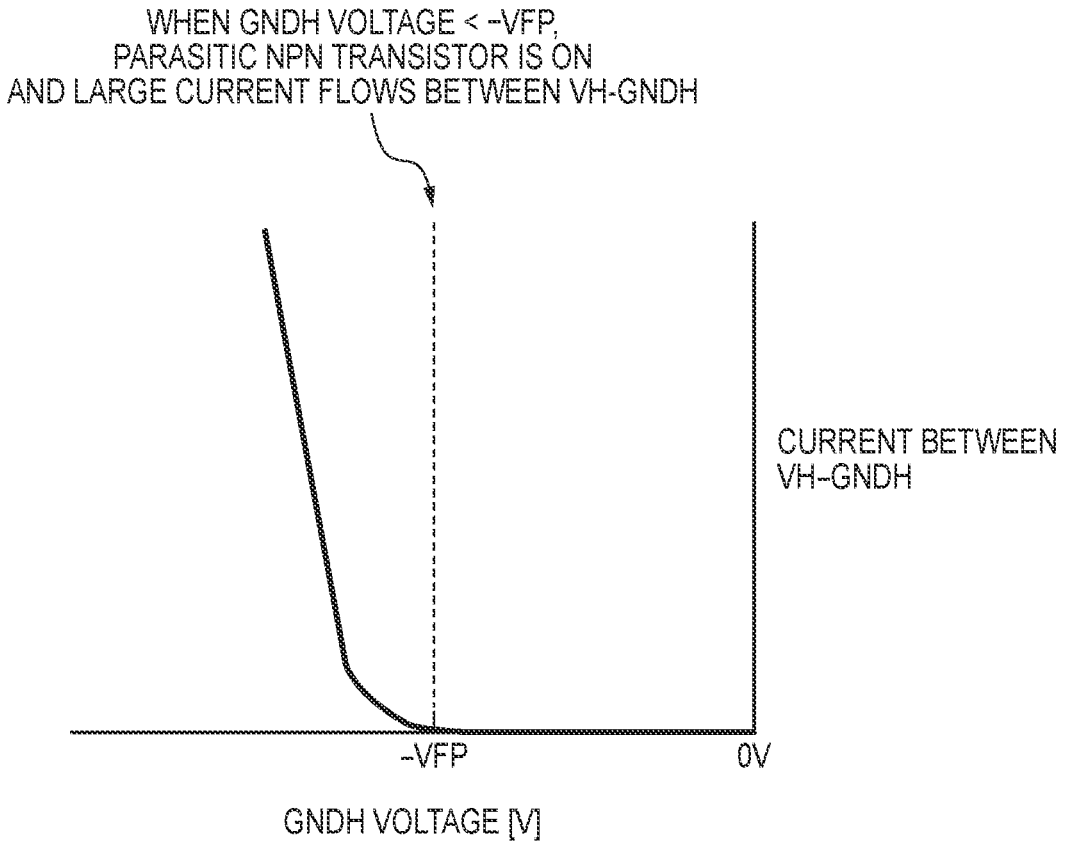
FIG. 8 is a view for describing current characteristics of a parasitic NPN transistor of the driving element.

FIG. 7 is a view illustrating a state in which a parasitic NPN transistor of a driving element (FET) entered an on state, and a malfunction occurred. Also, FIG. 8 is a view illustrating current characteristics of the parasitic NPN transistor. As illustrated in FIG. 8, when the GNDH voltage exceeds the forward voltage VFP (GNDH voltage<−VFP), the current increases exponentially. The large current flows in a path from VH to the heater to the drain terminal of the FET to the source terminal of the FET to GNDH. Accordingly, because current flows to the heater, it causes an erroneous printing operation and damage to the heater.

FIG. 4B illustrates a current path in a case when the capacitive element 113 is disposed on the print circuit board 107. Because an impedance with respect to alternating current between GNDH and VSS in the print circuit board 107 decreases due to the capacitive element 113, the current Y flows into GNDH via the capacitive element 113. Accordingly, it is possible to suppress large ringing to the negative side of GNDH according to the current Y because it does not pass through the cable 108 which has a large parasitic inductance. By this, the potential difference between GNDH and VSS ceases to exceed the forward voltage VFP of the parasitic transistor of the driving element (FET), and a malfunction of the driving element (FET) ceases to occur. Time t2 of FIG. 5B indicates that state.

By the foregoing configuration, it becomes possible to realize high reliability in the printhead according to embodiments by achieving both prevention of a malfunction in a logic circuit and prevention of a malfunction in a driving element.

Second Embodiment

Figure 9:
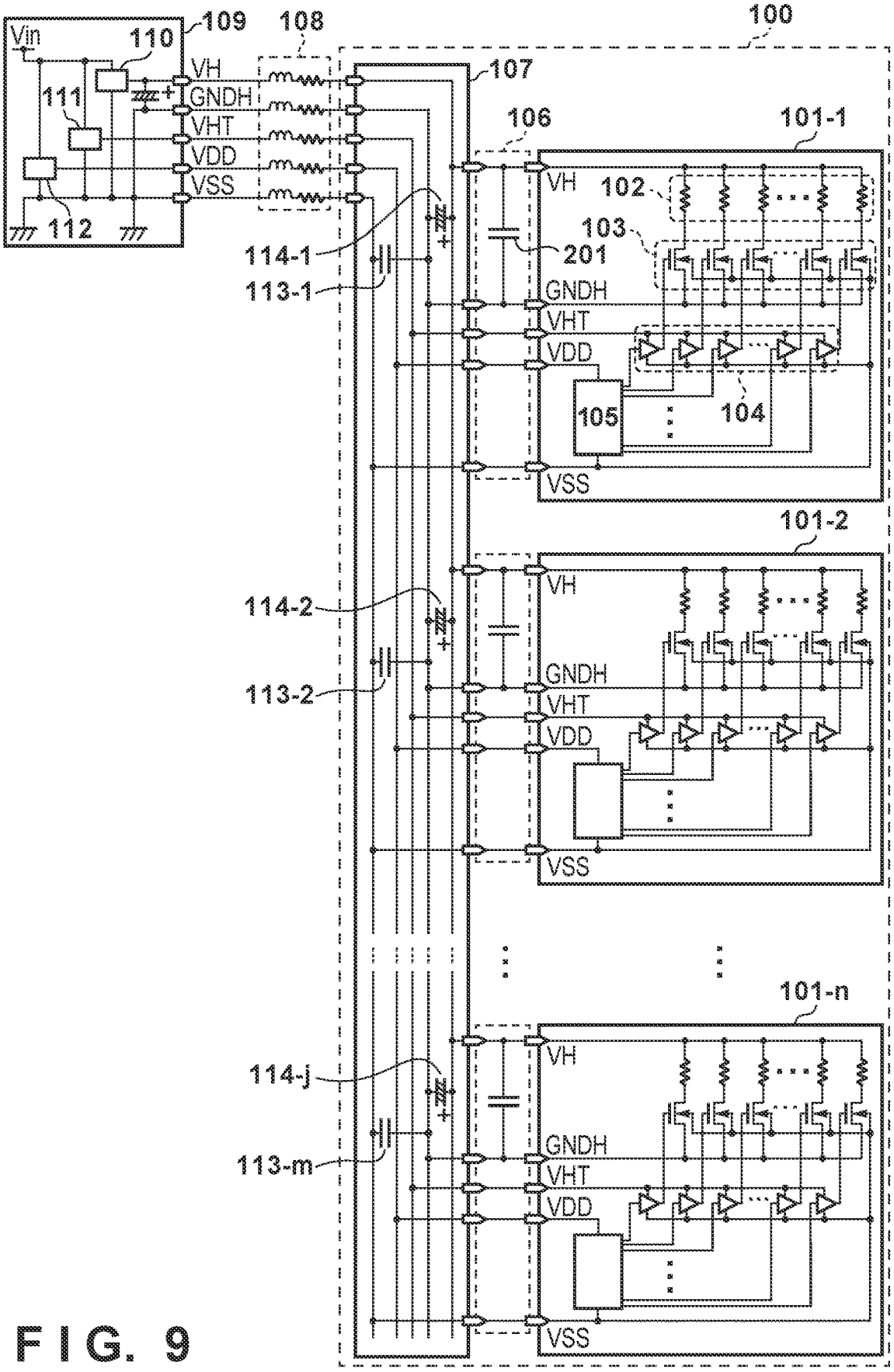
FIG. 9 is a view illustrating an example of a configuration of the printhead according to a second embodiment.

FIG. 9 illustrates an example of a configuration of the printhead 100 in the printing apparatus according to a second embodiment of the present invention. The difference from the first embodiment is that a capacitor 201 between VH and GNDH is disposed on the flexible substrate 106. Other configurations are the same as in the first embodiment and so description thereof is omitted.

For the capacitor 201, a chip ceramic capacitor of several μF to several tens of μF, for example, is used. The capacitor 201 fulfills the role of suppressing ringing of GNDH that occurs due to the current X between VH and GNDH. Specifically, the capacitor 201 suppresses the influence of ringing due to the current X that flows for a small parasitic inductance of the flexible substrate 106.

Figure 10:
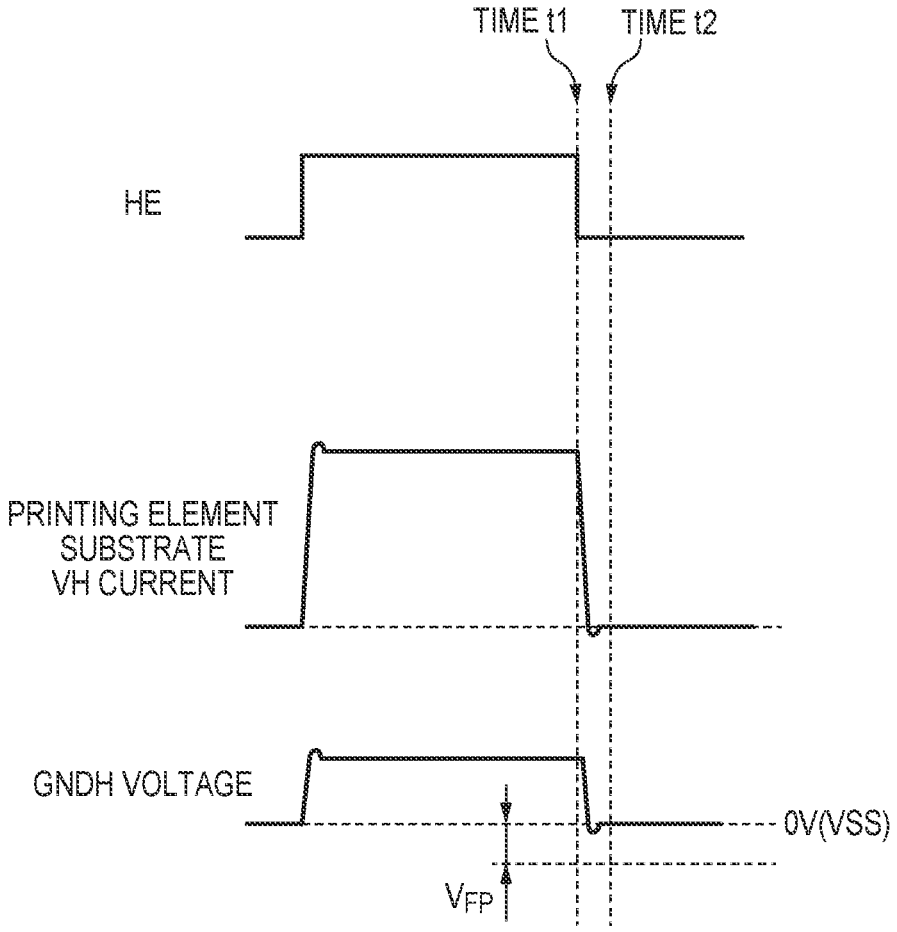
FIG. 10 is a view for describing operation waveforms of the printhead according to the second embodiment.

FIG. 10 illustrates operation waveforms of the printhead 100 in the printing apparatus according to a second embodiment. By the capacitor 201, it is possible to suppress ringing to the negative side of GNDH due to the current X. By this, a sufficient margin is taken in relation to the forward voltage VFP of the parasitic transistor of the driving element (the FET) for the potential difference between GNDH and VSS. Accordingly, with the printhead according to a second embodiment, it is possible to realize a more reliable printhead because the margin in relation to driving element malfunction prevention is wider than the first embodiment due to the two suppression elements.

Third Embodiment

Figure 11:
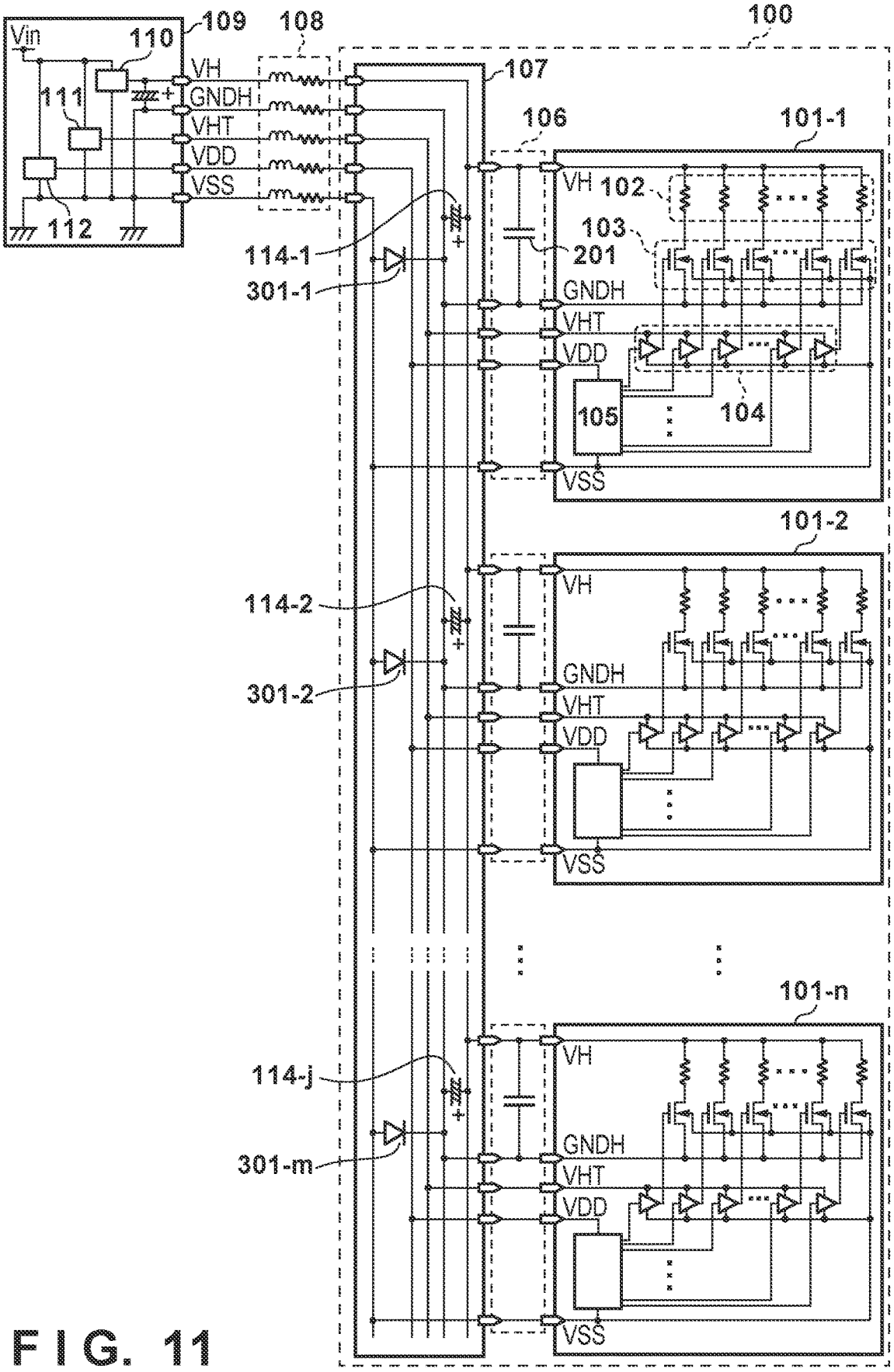
FIG. 11 is a view illustrating an example of a configuration of the printhead according to a third embodiment.

FIG. 11 illustrates an example of a configuration of the printhead 100 in the printing apparatus according to a third embodiment of the present invention. What is different from the second embodiment is that the capacitive element 113 of the print circuit board 107 is replaced with a rectification element 301. That is, in the present embodiment, a rectification element is used as the suppression element.

Figure 12:
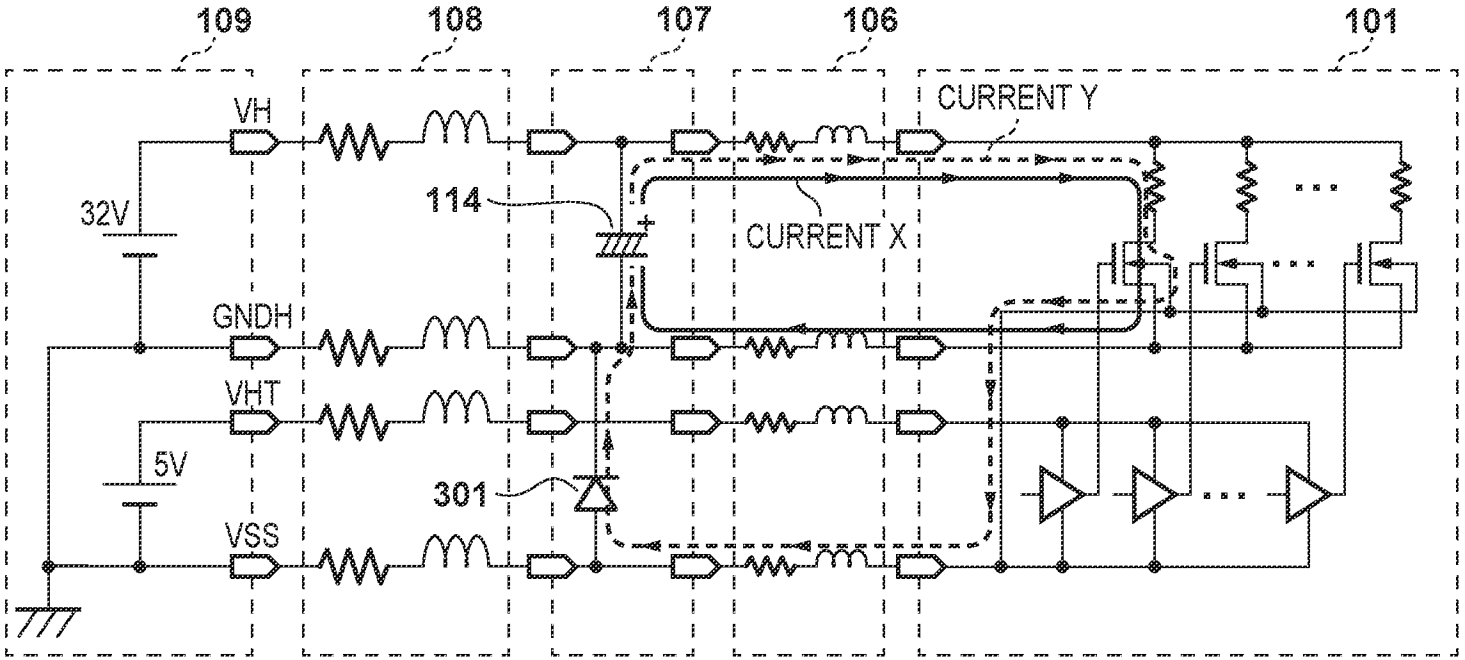
FIG. 12 is a view for describing an equivalent circuit of the printhead according to the third embodiment.

The anode terminal side of the rectification element 301 is connected to VSS, and the cathode terminal side is connected to GNDH. Also, the forward voltage VFD of the rectification element 301 is made to be lower than the forward voltage VFP of the parasitic NPN transistor of the driving element (FET). By this, if a negative potential occurs between GNDH and VSS, current flows to the cathode terminal from the anode terminal of the rectification element 301 (refer to FIG. 12). Accordingly, a potential between GNDH and VSS is clamped to the forward voltage VFD of the rectification element 301. Because |VFD|<|VFP|, the parasitic NPN transistor of the driving element (FET) is reliably off, and it is possible to prevent a malfunction of the driving element (FET). Something for which the forward voltage to the rectification element 301 between the ground wirings is small and the response speed is fast is suitable, and a Schottky barrier diode for example may be used.

Fourth Embodiment

Figure 13:
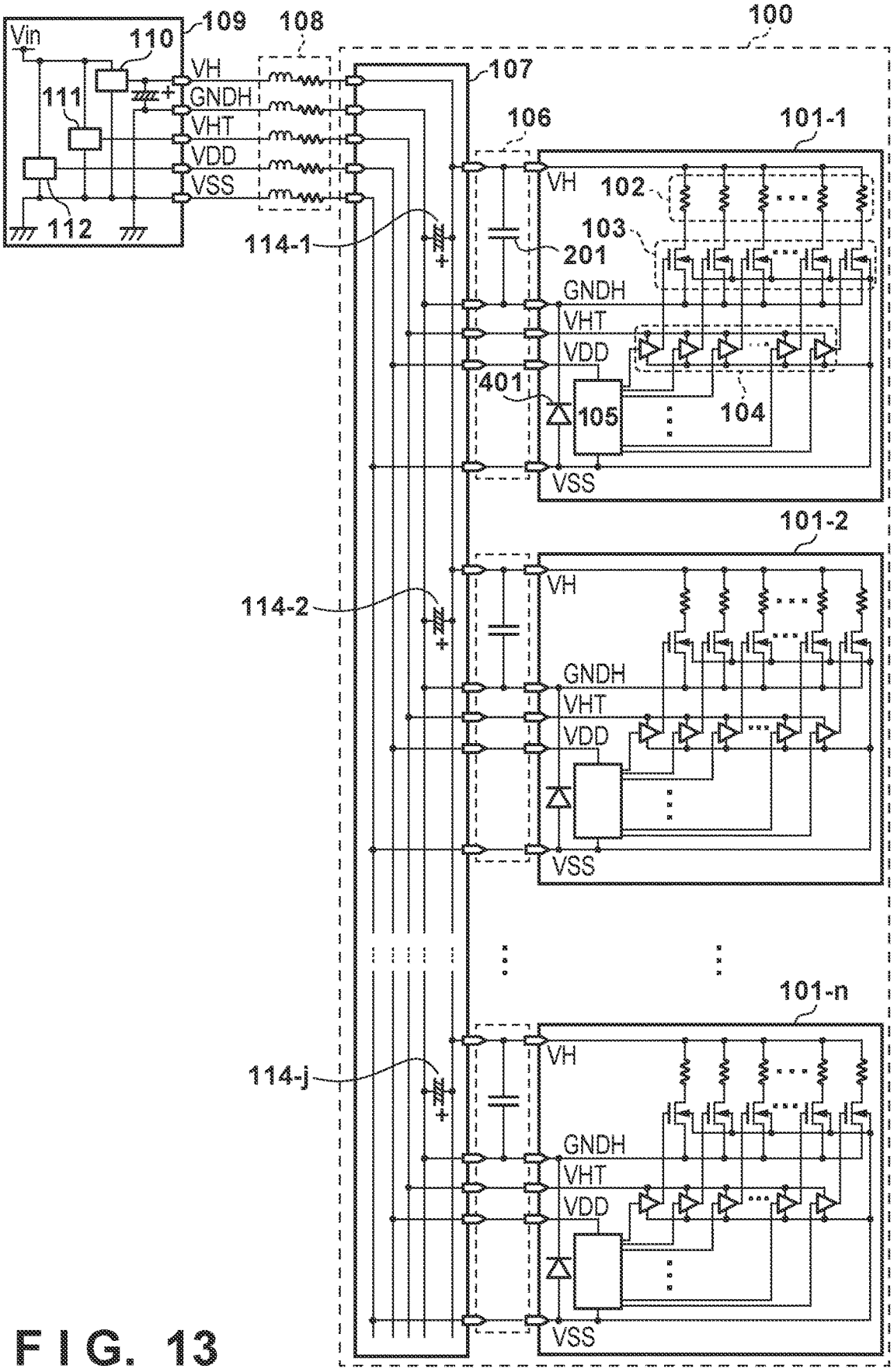
FIG. 13 is a view illustrating an example of a configuration of the printhead according to a fourth embodiment.
Figure 14:
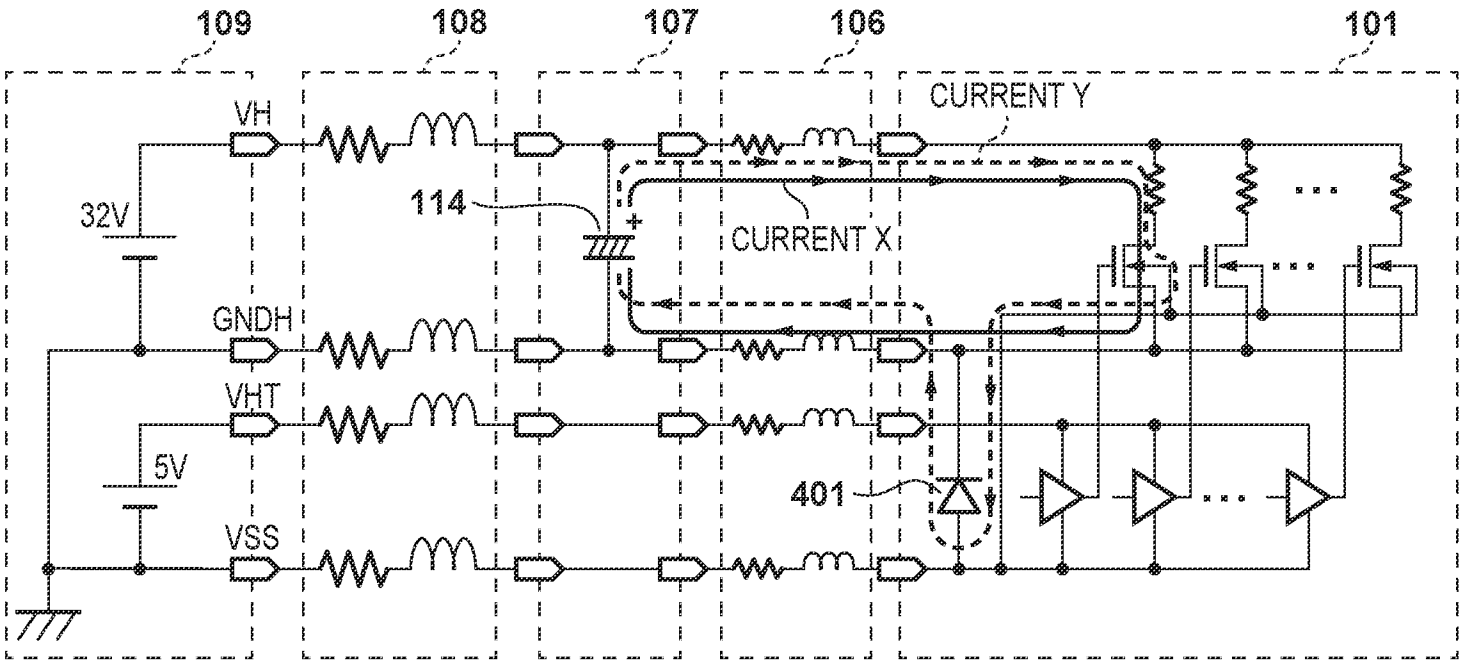
FIG. 14 is a view for describing an equivalent circuit of the printhead according to the fourth embodiment.

FIG. 13 illustrates an example of a configuration of the printhead 100 in the printing apparatus according to a fourth embodiment of the present invention. Also, FIG. 14 indicates an equivalent circuit of the printhead 100 in the fourth embodiment. What is different from the third embodiment is that a rectification element 401 is integrated in the printing element substrate 101. Since the function of the rectification element 401 is similar to the third embodiment, description thereof is omitted. Other configurations are the same as in the foregoing embodiments and so description thereof is omitted.

There is the merit that, by the configuration of the present embodiment, it is possible to reduce the number of parts that are implemented on the print circuit board 107 while achieving a similar effect to the third embodiment, and so the cost is reduced.

Fifth Embodiment

Figure 15:
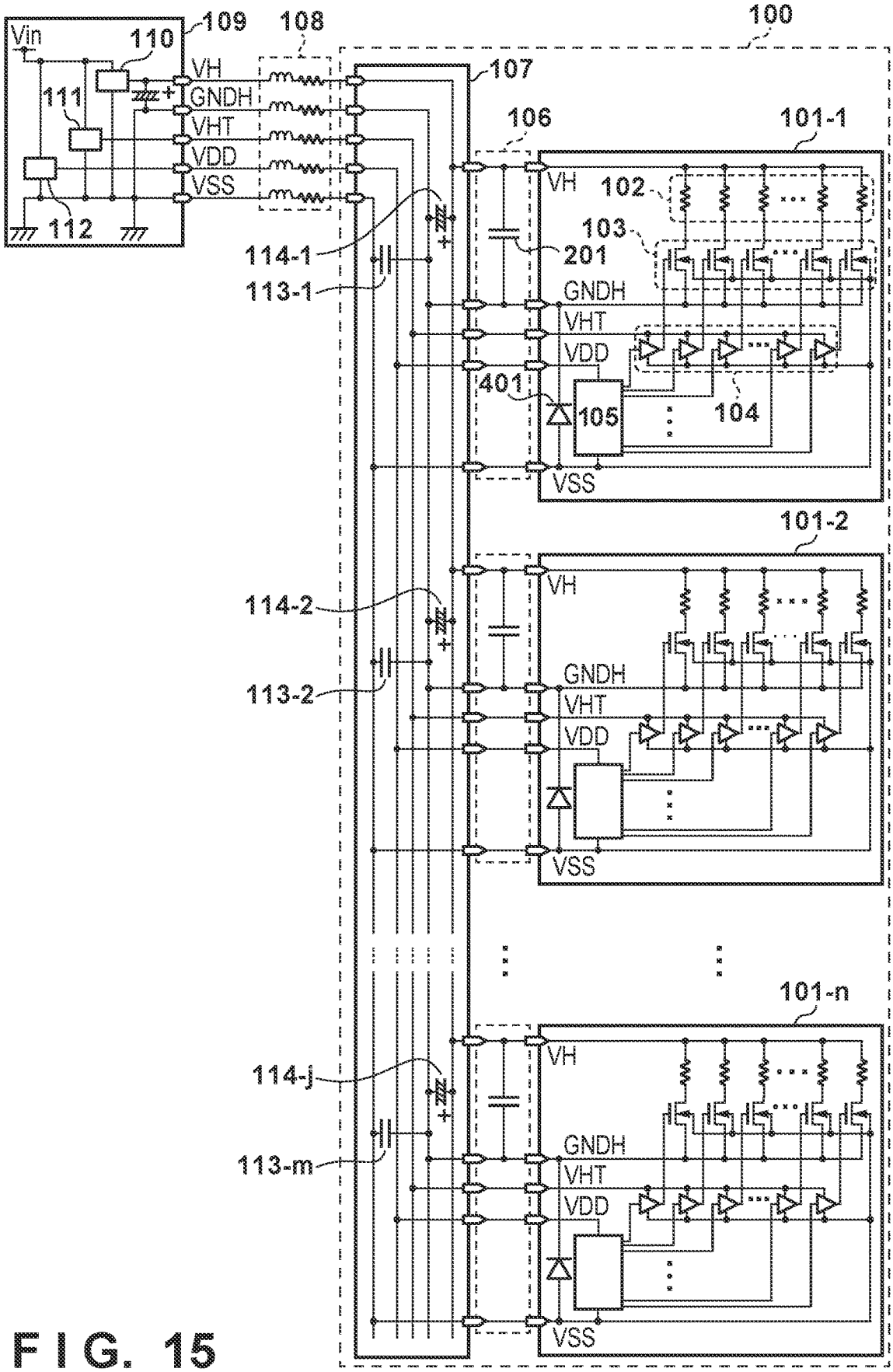
FIG. 15 is a view illustrating an example of a configuration of the printhead according to a fifth embodiment.

FIG. 15 illustrates an example of a configuration of the printhead 100 in the printing apparatus according to a fifth embodiment of the present invention. What is different from the fourth embodiment is that the capacitive element 113 is added on the print circuit board 107. Because the rectification element 401 illustrated in the fourth embodiment is integrated in the printing element substrate 101, there are cases in which the capability with respect to current flow is insufficient.

Accordingly, in the present embodiment, the capacitive element 113 fulfills the role of supporting flow of current from VSS to GNDH. That is, it is possible to achieve an improved effect by comprising both the rectification element 401 integrated in the printing element substrate 101 and the capacitive element 113 arranged on the print circuit board 107. Other configurations are the same as in the foregoing embodiments and so description thereof is omitted.

By the configuration of the present embodiment, the margin in relation to driving element malfunction prevention widens, and it is possible to realize a more reliable printhead.

Sixth Embodiment

Figure 16:
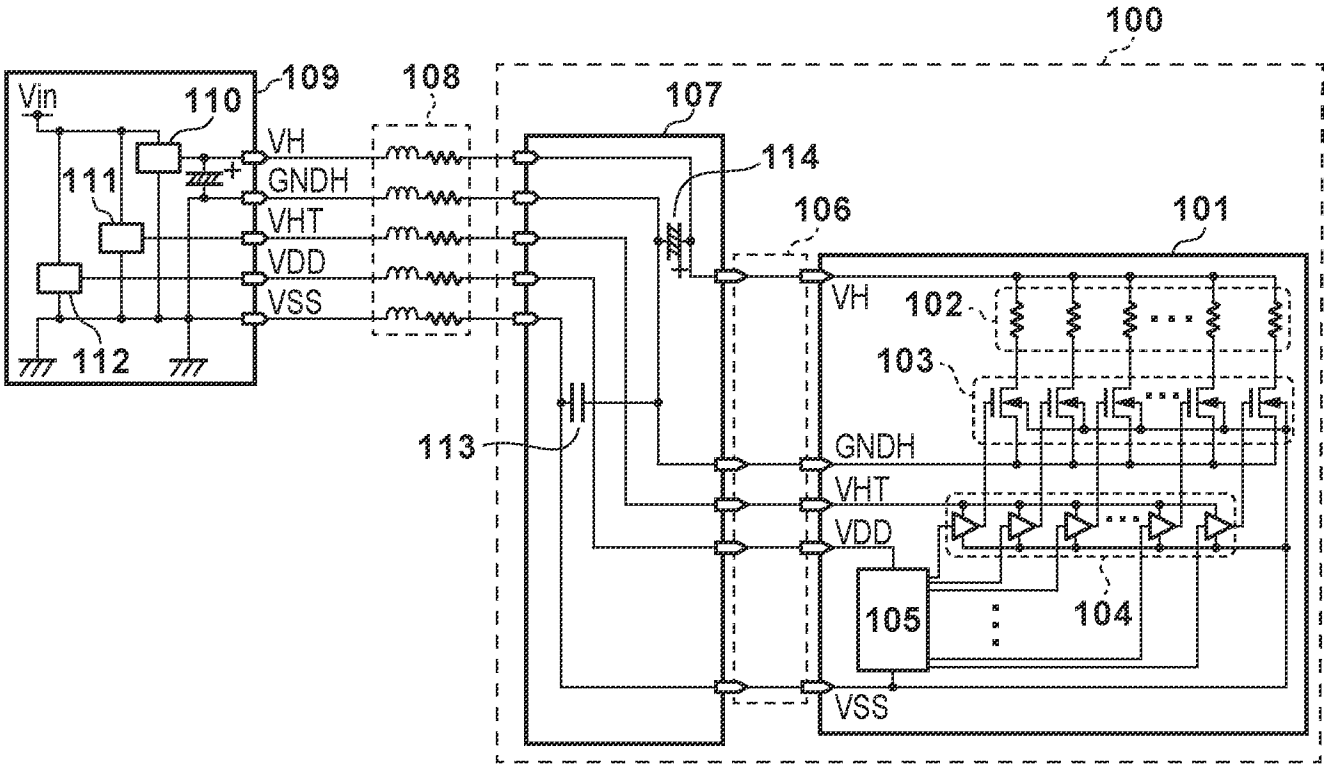
FIG. 16 is a view illustrating an example of a configuration of the printhead according to a sixth embodiment.

FIG. 16 illustrates an example of a configuration of the printhead 100 in the printing apparatus according to a sixth embodiment of the present invention. In the first to fifth embodiments, examples of line heads in which the printing element substrate 101 is plurally arranged are illustrated. In contrast, an example of a serial head in which only one of the printing element substrate 101 is arranged is illustrated in the sixth embodiment. There are cases in which a wiring length of the cable 108 is 1 meter or more in serial heads and not only line heads, and the value of the parasitic inductance is large. For that reason, the problem of a malfunction of a driving element due to ringing is a concern for serial heads as well.

Apparatus Configuration

Figure 17A:
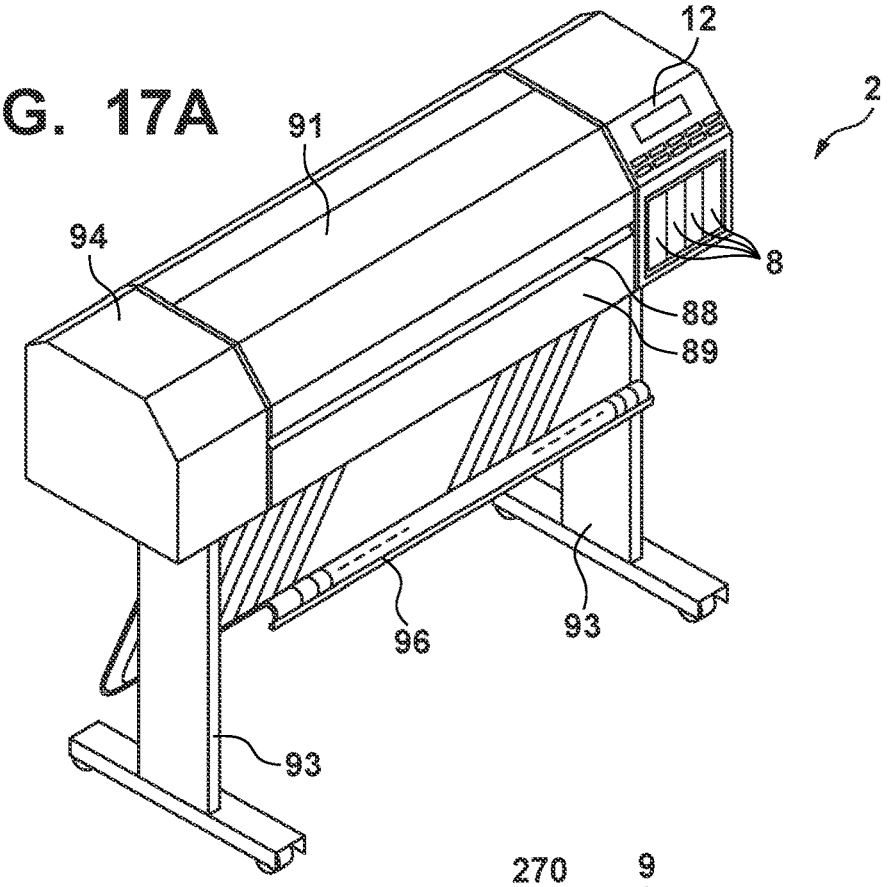
FIGS. 17A and 17B are external perspective views illustrating an example of a configuration of an inkjet printing apparatus.
Figure 17B:
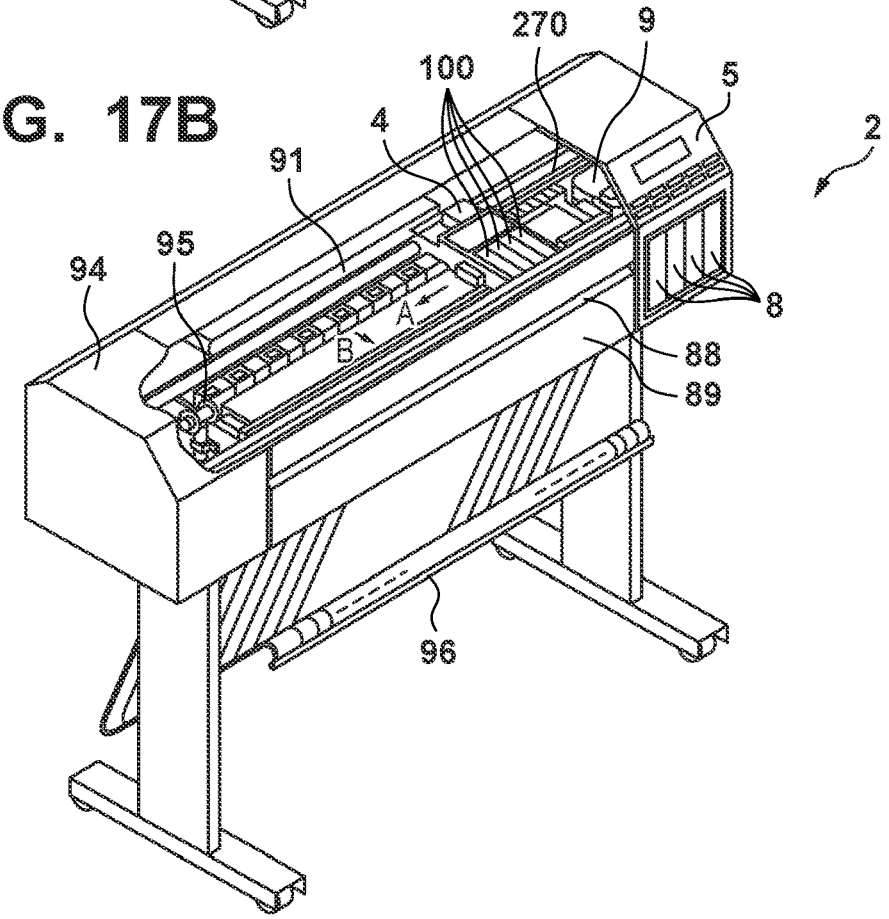

Firstly, an example of a configuration of a serial head printing apparatus according to the present embodiment is described. FIG. 17A and FIG. 17B are external perspective views of a printing apparatus that uses print mediums of an A0 and a B0 size, and FIG. 17B is a perspective view illustrating a state in which an upper cover of the printing apparatus illustrated in FIG. 17A is removed.

As illustrated in FIG. 17A, a manual feed insertion port 88 is disposed on the front surface of a printing apparatus 2, and a roll paper cassette 89 that can open and close to the front is disposed on the bottom part thereof, and a print medium such as printing paper is supplied to the inside of the printing apparatus from the manual feed insertion port 88 or the roll paper cassette 89. The printing apparatus 2 comprises an apparatus body 94 supported by two legs 93, a stacker 96 on which discharged print mediums are stacked, and an upper cover 91 that is transparent so that the inside can be seen and that can be opened and closed. Also, on the right side of the apparatus body 94, an operation panel 12, an ink supply unit, and an ink tank are disposed.

As illustrated in FIG. 17B, the printing apparatus 2 further comprises a conveyance roller 95 for conveying a print medium in the direction of the arrow symbol B (the sub scanning direction) and a carriage 4 that is guided/supported to be able to move back and forth widthwise with respect to the print medium (the direction of the arrow symbol A—main scanning direction). The printing apparatus 2 further comprises a carriage motor (not shown) for causing the carriage 4 to move back and forth in the direction of arrow symbol A, a carriage belt (hereinafter referred to as the belt) 270, and the printhead 100 which is attached to the carriage 4. Furthermore, a suction-type ink recovery unit 9 for fixing an ink discharge failure due to clogging of a discharge port of the printhead 100 together with ink supply is provided.

In the case of such a printing apparatus, the printhead 100, which comprises four heads corresponding to four colors of ink for performing color printing on a print medium, is mounted on the carriage 4. In other words, in the printhead 100, a K head for discharging K (black) ink, a C head for discharging C (cyan) ink, an M head for discharging M (magenta) ink, and a Y head for discharging Y (yellow) ink are provided, for example.

When printing on a print medium is performed in the foregoing configuration, a print medium is conveyed to a predetermined printing start position by the conveyance roller 95. Thereafter, printing corresponding to the entire print medium is performed by repeating an operation of causing the printhead 100 to scan in the main scanning direction by the carriage 4 and an operation of causing the print medium to be conveyed in a sub scanning direction by the conveyance roller 95.

In other words, printing on a print medium is performed by the carriage 4 moving in the direction of the arrow symbol A illustrated in FIG. 17B by a carriage motor (not shown) and the belt 270. When returning to the position prior to the carriage 4 scan (home position), the print medium is conveyed in the sub scanning direction (direction of the arrow symbol B illustrated in FIG. 17B) by the conveyance roller, and thereafter, the carriage once again scans in the direction of the arrow symbol A in FIG. 17B. Printing of images, characters, or the like on a print medium is performed in this way. When the foregoing operation is further repeated, and printing of one print medium ends, the print medium is discharged in the stacker 96, and one sheet's worth of printing is completed.

Note that the control configuration of the printing apparatus is similar to what was described using FIG. 2.

In the present embodiment, by the capacitive element 113 being disposed between the ground wirings, the potential difference between GNDH and VSS is suppressed and it is possible to prevent a malfunction. Accordingly, the present invention can be applied to a serial head embodiment and not only a full line head and a similar effect can be achieved. Note that other configurations are similar to the first embodiment and so description thereof is omitted.

Seventh Embodiment

Figure 18:
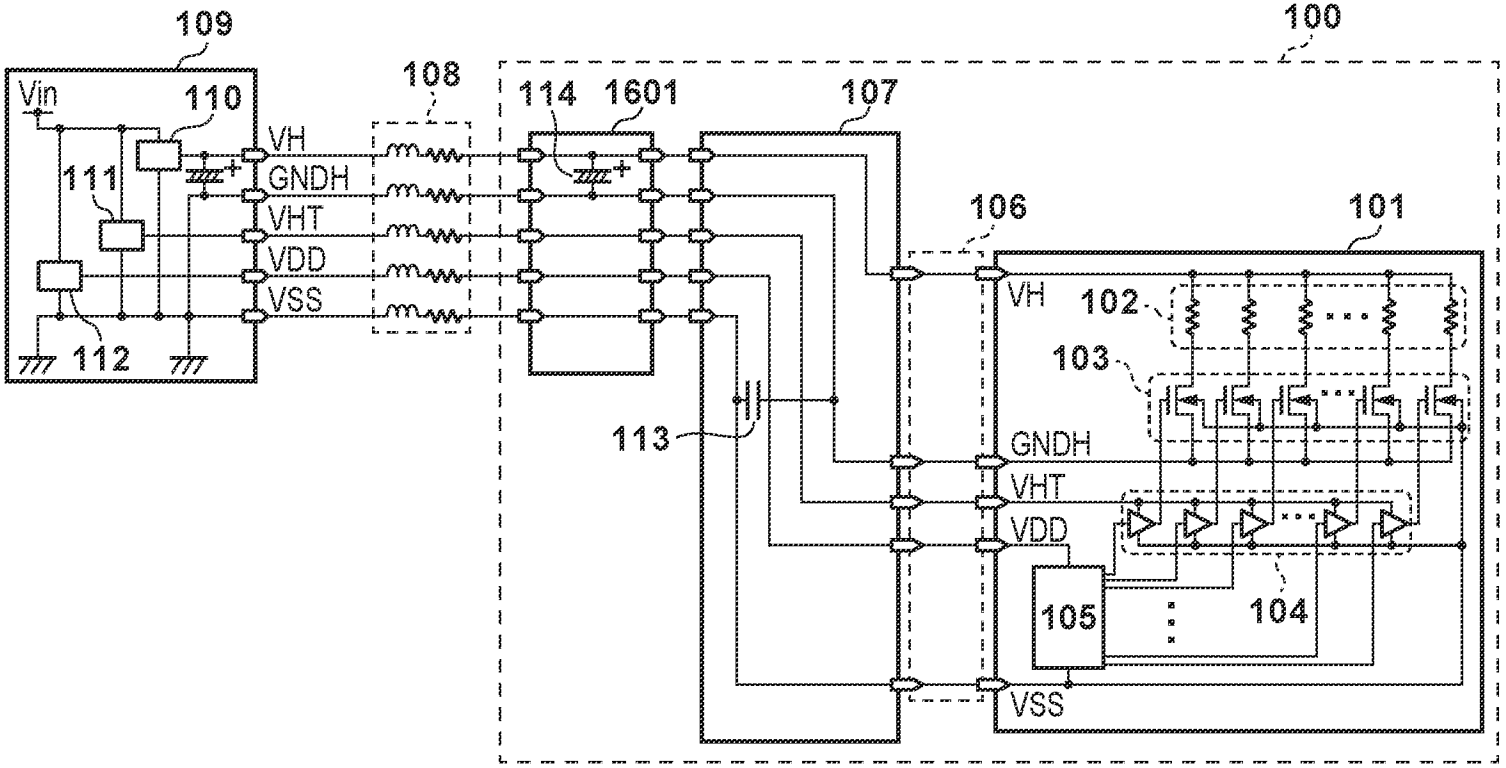
FIG. 18 is a view illustrating an example of a configuration of the printhead according to a seventh embodiment.

FIG. 18 illustrates an example of a configuration of the printhead 100 in the printing apparatus according to a seventh embodiment of the present invention. What is different from the sixth embodiment is that a carriage substrate 1601 is added and the capacitor 114 between VH and GNDH is arranged on the carriage substrate 1601. That is, this embodiment also corresponds to a serial head.

The capacitive element 113 is arranged on the print circuit board 107. The carriage substrate 1601 is connected to the head control substrate 109 via the cable 108. Also, the carriage substrate 1601 is connected to the print circuit board 107 via the connector. Other configurations are similar to the sixth embodiment and so description thereof is omitted.

As illustrated by the present embodiment, the present invention can also be applied to a configuration comprising a carriage substrate in a serial head printing apparatus, and can achieve a similar effect to the sixth embodiment.

Eighth Embodiment

Figure 19:
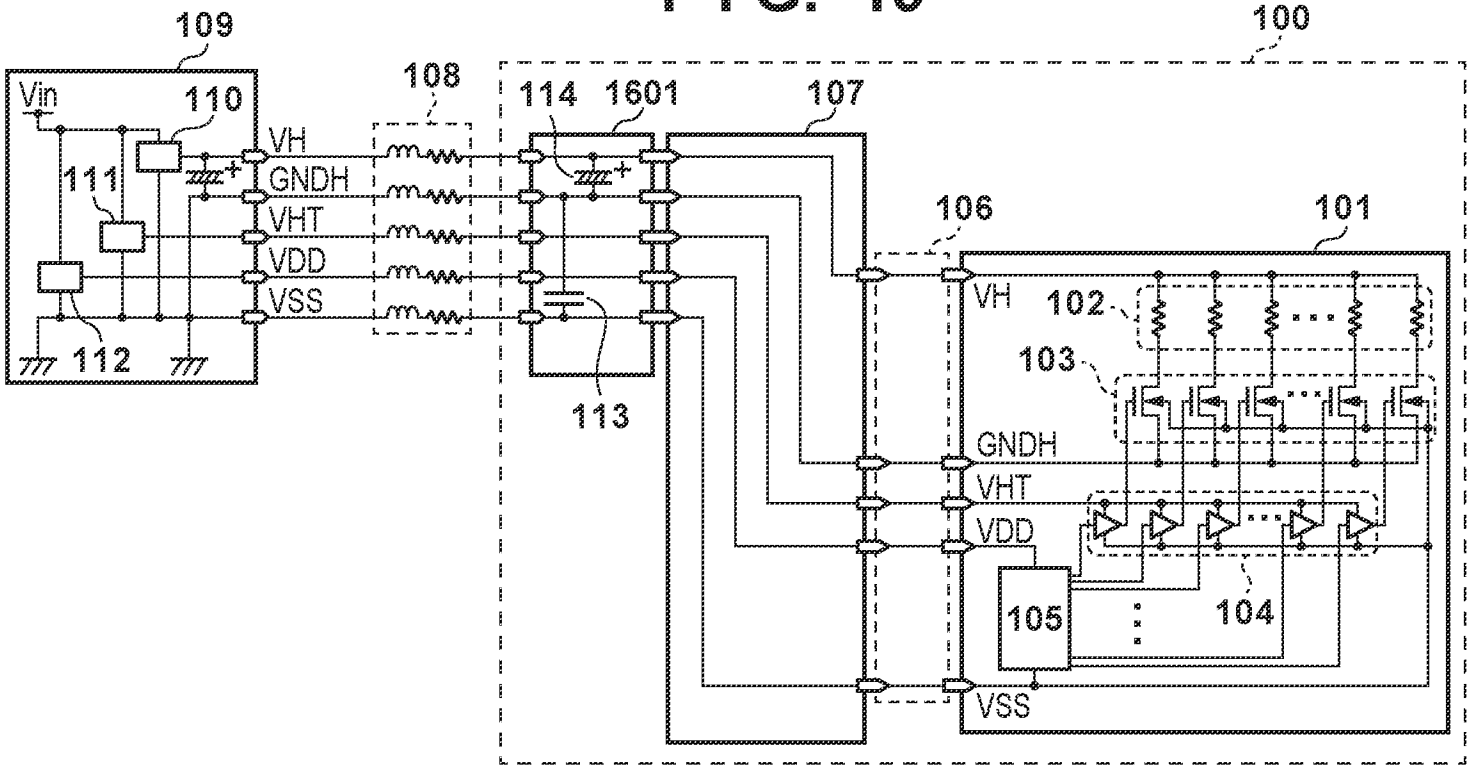
FIG. 19 is a view illustrating an example of a configuration of the printhead according to an eighth embodiment.

FIG. 19 illustrates the printhead 100 in an inkjet printing apparatus according to an eighth embodiment of the present invention. What is different from the seventh embodiment is that the capacitive element 113 between the ground wirings is arranged on the carriage substrate 1601. Other configurations are similar to the sixth embodiment and so description thereof is omitted.

By the present embodiment, it is possible to achieve a similar effect to the seventh embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printhead, comprising:

a printing element;

a first power supply wiring configured to be electrically connected to one terminal of the printing element and supply power to the printing element;

a transistor configured to be electrically connected to another terminal of the printing element and drive the printing element;

a control circuit configured to control the transistor;

a first ground wiring configured to be electrically connected to a source of the transistor;

a second ground wiring configured to be electrically connected to a ground terminal of the control circuit;

a first capacitive element configured to be electrically connected, at one terminal thereof, to the first ground wiring and electrically connected, at another terminal thereof, to the second ground wiring;

an element substrate; and a wiring substrate, wherein the printing element and the transistor are disposed on the element substrate, and the first capacitive element is disposed on the wiring substrate.

2. The printhead according to claim 1, wherein the printhead further includes a second capacitive element disposed on the wiring substrate, and one terminal of the second capacitive element is electrically connected to the first power supply wiring and another terminal of the second capacitive element is electrically connected to the first ground wiring.

3. The printhead according to claim 2, wherein the printhead includes a plurality of element substrates, and the first capacitive element and the second capacitive element are each plurally disposed on the wiring substrate.

4. The printhead according to claim 3, wherein the printhead further includes a third capacitive element and a plurality of flexible substrates connected between each of the plurality of element substrates and the wiring substrate, and the third capacitive element is disposed on at least one of the plurality of flexible substrates.

5. The printhead according to claim 4, wherein a static capacitance of the third capacitive element is determined to be larger than the static capacitance of the first capacitive element and smaller than a static capacitance of the second capacitive element.

6. The printhead according to claim 2, wherein the printhead further includes at least two wiring substrates including a first wiring substrate and a second wiring substrate, the printing element and the transistor are disposed on the element substrate, the first capacitive element is disposed on the first wiring substrate, and the second capacitive element is disposed on the second wiring substrate.

7. The printhead according to claim 2, wherein a static capacitance of the first capacitive element is determined to be smaller than a static capacitance of the second capacitive element.

8. The printhead according to claim 2, wherein the first capacitive element includes a ceramic capacitor, and the second capacitive element includes an electrolytic condenser.

9. The printhead according to claim 1, wherein the printhead further includes a second power supply wiring configured to supply power to the control circuit.

10. The printhead according to claim 1, wherein the control circuit comprises at least one of a shift register circuit and a latch circuit for holding print data, and a heat enable generation circuit for generating a heat-enable pulse for deciding the driving time of the transistor.

11. A printing apparatus, comprising:

a printhead and a control substrate, the printhead comprising:

a printing element;

a power supply wiring configured to be electrically connected to one terminal of the printing element and supply power to the printing element;

a transistor configured to be electrically connected to another terminal of the printing element and drive the printing element;

a control circuit configured to control the transistor;

a first ground wiring configured to be electrically connected to a source of the transistor;

a second ground wiring configured to be electrically connected to a ground terminal of the control circuit;

a first capacitive element configured to be electrically connected, at one terminal thereof, to the first ground wiring and electrically connected, at another terminal thereof, to the second ground wiring;

an element substrate; and a wiring substrate, wherein the printing element and the transistor are disposed on the element substrate, and the first capacitive element is disposed on the wiring substrate, and the control substrate comprising:

a power circuit configured to be connected to the printing element via the power supply wiring and generate power to be supplied to the printing element, wherein the first ground wiring and the second ground wiring are electrically connected on the control substrate.

12. The printing apparatus according to claim 11, wherein the printhead further includes a second capacitive element disposed on the wiring substrate, and one terminal of the second capacitive element is electrically connected to the power supply wiring and another terminal of the second capacitive element is electrically connected to the first ground wiring.

13. The printing apparatus according to claim 12, wherein the printhead includes a plurality of element substrates, and the first capacitive element and the second capacitive element are each plurally disposed on the wiring substrate.

14. The printing apparatus according to claim 12, wherein a static capacitance of the first capacitive element is determined to be smaller than a static capacitance of the second capacitive element.

15. The printing apparatus according to claim 11, wherein the printhead further includes a second power supply wiring configured to supply power to the control circuit.

16. The printing apparatus according to claim 11, wherein the printhead further includes a cable that connects the printhead and the control substrate, and the cable includes the power supply wiring, the first ground wiring, and the second ground wiring.

17. The printing apparatus according to claim 11, wherein the control circuit comprises at least one of a shift register circuit and a latch circuit for holding print data, and a heat enable generation circuit for generating a heat-enable pulse for deciding the driving time of the transistor.

* * * * *